United States Patent [19]

Resch

[11] Patent Number: 4,867,391

[45] Date of Patent: Sep. 19, 1989

[54] ADJUSTABLE REEL

[75] Inventor: Joseph B. Resch, Johnston, R.I.

[73] Assignee: Metlon Corporation, R.I.

[21] Appl. No.: 213,085

[22] Filed: Jun. 29, 1988

[51] Int. Cl.[4] ..... B65H 75/14

[52] U.S. Cl. ..... 242/118.5; 242/71.9

[58] Field of Search ..... 242/71.8, 71.9, 110, 242/110.3, 115, 773, 77.4, 118.5, 118.6, 118.61

[56] References Cited

U.S. PATENT DOCUMENTS

| | | | |
|---|---|---|---|
| 2,554,085 | 5/1951 | Blanchard | 242/118.5 |
| 2,578,018 | 12/1951 | Rovas | 242/118.5 |
| 4,428,546 | 1/1984 | Weideman | 242/71.9 X |
| 4,471,920 | 9/1984 | Ditton et al. | 242/118.61 |

*Primary Examiner*—Stuart S. Levy
*Assistant Examiner*—Steven M. duBois
*Attorney, Agent, or Firm*—Ostrolenk, Faber, Gerb & Soffen

[57] ABSTRACT

An adjustable reel or a spool has a pair of flanges connected by a shaft or barrel wherein each flange has a plurality of extensions arranged circumferentially and directed toward the opposite flange. Each flange has a plurality of openings spaced to match the extensions from the opposite flange which may enter thereinto. The extensions are spaced to be interleaved. In the preferred form, the extensions are spaced transversely, preferably 60° and also extend 60°. The two flanges, when placed with the extensions interleaved, form a single reel with a secure connecting shaft or barrel between them providing a solid support for material to be wound thereon. The spacing of the spool between flanges is infinitely adjustable. Preferably, each flange and its extensions are made from a mold of the same type so that the opposite flanges are mirror images of each other and may readily be placed together. The curvatures at the base of each extension match with each other when they are placed together to form a continuous substantially tubular structure which forms an efficient bearing for the reel.

6 Claims, 1 Drawing Sheet

FIG. 1.
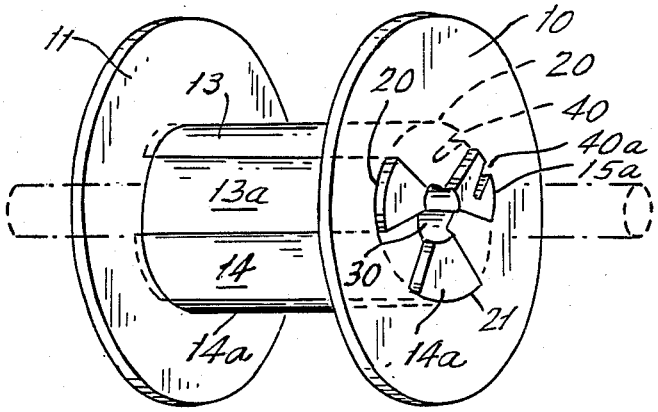
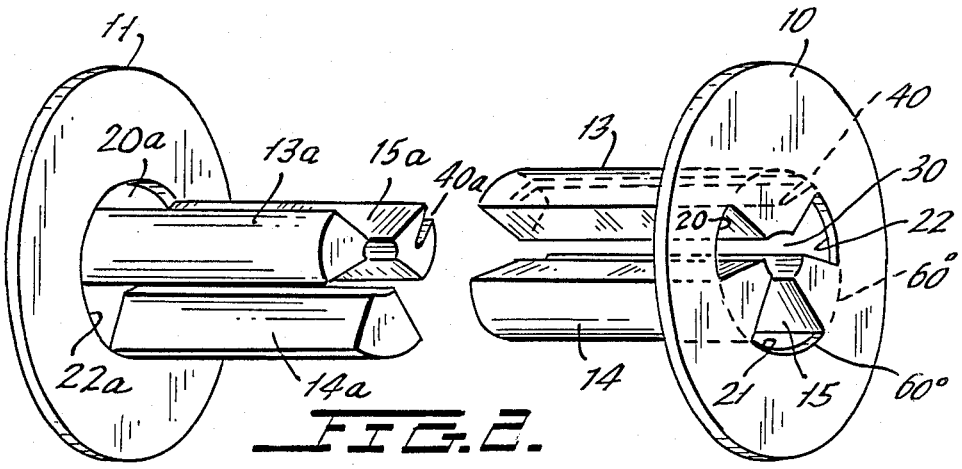
FIG. 2.
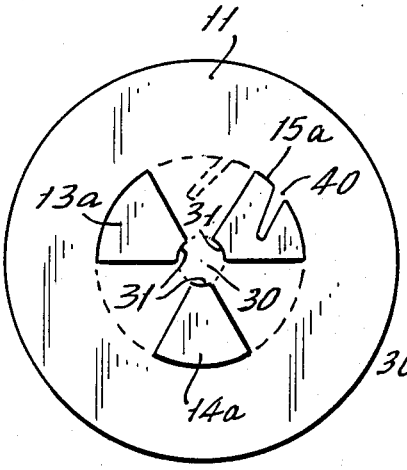
FIG. 3.
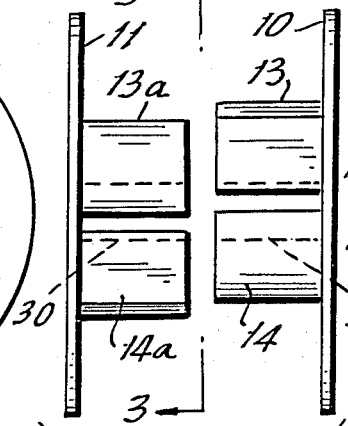
FIG. 4.
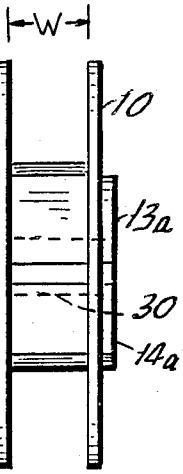
FIG. 5.

ADJUSTABLE REEL

BACKGROUND OF THE INVENTION

The present invention relates to an adjustable reel so arranged that it is formed from two halves which are preferably identical and may well be formed from a single mold and which are mirror images of each other. Each of the two halves comprises a principal reel flange and projecting segments which may be so arranged as to interleave with each other and may thereby be connected to form a shaft on which material may be wound.

One of the essential elements of the present invention is that the elements which project and interleave to form the shaft on which winding takes place form, together, a single continuous bore of circular cross-section which may constitute a single continuous bearing for the reel upon a mounting shaft, a driving shaft or a driven shaft. The shaft of the reel is arranged so that the flanges at opposite ends may be adjusted in their spacing from each other and become essentially continuous for the purpose of supporting the material to be wound between them Where the flanges are to be placed close together, the elements forming the shaft may extend from between the two flanges to the outside of the flanges, but in that case may form part of a driving or driven connection between the spool or reel and other mechanism.

While the terms "spool" and "reel" are often referred to interchangeably, for the purpose of the present description, a spool may be regarded as a device having a pair of parallel flanges and a shaft between on which the material is wound in a series of layers of helically-wound material. A reel may be regarded, as one in which the material to be wound extends at each turn essentially from one flange to the other and the material to be wound, as for instance in a sound tape machine or movie machine, comprises a plurality of successive rectangular cross-section layers substantially parallel to one another to be wound upon and coterminous with each other.

The utilization of reels and spools is well known. See, for instance, prior U.S. Pat. Nos. 3,743,209; 3,999,139; 4,068,808; 4,428,546; 4,471,920 and 4,570,469. See also Netherlands 1977 Pat. 7,512,207 and British 1976 Pat. 1,430,735. The structures in each case consist of a pair of flanges and a shaft between interconnecting the two flanges. Where the flanges have been made by a single mold so that opposite ends of the reel are mirror images of each other, the structures were each made with flanges and members extending from each flange to form at least part of the shaft of the spool reel. Where the shafts have been interconnected to form an integral reel unit, this interconnection has most frequently been a solid interconnection making the reel unit a completely integral element. Various means were required for mounting the spool unit, treating it primarily as a solid, single element.

SUMMARY OF THE INVENTION

In the present invention, one of the essential elements is the utilization of a plurality of shaft segments, each extending from one of the two opposite flanges of the reel and so arranged that they may be interleaved with each other in order to form the shaft on which the material for the reel is wound. The elements which extend from the flanges and are interleaved are so arranged that together they form essentially a tubular longitudinal member within the reel which tubular longitudinal member may act as a continuous support for the spool or reel on a shaft, and such tubular element may rotate with respect to the support shaft or be secured thereto, or may drive the shaft or be driven thereby.

However, the arrangement is such that a symmetrical arrangement of such extensions form together the continuous inner surface of the tubular section to provide complete and continuous support for the spool or reel. If necessary, when the members are joined with the two flanges at maximum spacing, an additional filler piece may be provided on the shaft to provide a flange support for the material wound on the spool or reel. Therefore, each flange is provided with extensions which may interleave with the extensions of the opposite flange, the extensions running normal to the faces of the flange and each flange is provided with recesses or openings to receive the extensions from the opposite flange.

Where such extensions go right through and pass the opposite surface of the opposite flange, then such extensions may comprise part of the drive for the spool or reel. Such extensions may be cut off, if desired, at the outer surface of each flange, thereby foregoing the advantage which may occur from providing extensions which can be used as part of the drive. Such extensions may also be fixed with respect to the flanges in any suitable manner, either permanent or reusable, such as by an adhesive which may be permanent or may be removed, or by other securing means which may be permanent or may be removed. The adjustment, however, is infinitely adjustable for any dimensions that may be desired or required by different customers for any particular spacing or length of the shaft between the flanges.

BRIEF DESCRIPTION OF THE DRAWINGS

The foregoing and many other objects of the present invention will become apparent in the following description and drawings in which:

FIG. 1 is a perspective view of a reel or spool made in accordance with the present invention.

FIG. 2 is an expanded view of the reel or spool of FIG. 1 with the parts arranged for engagement with each other.

FIG. 3 is an end view of one of the elements of FIG. 2 taken from line 3—3 of FIG. 4 looking in the direction of the arrows.

FIG. 4 is a side elevation view of the structure of FIG. 2 with the parts arranged ready for insertion.

FIG. 5 is a side view of the structure of FIG. 1 with the parts inserted.

DESCRIPTION OF THE PREFERRED EMBODIMENTS

Referring to the Figures, the reel of the present invention comprises the flanges 10 and 11. Each of the flanges 10 and 11 has a plurality of extensions 13, 14, 15 extending from flange 10 and 13*a*, 14*a*, 15*a* extending from flange 11. Each of the extending elements 13, 14, 15 and 13*a*, 14*a*, 15*a* on each side, extends in the illustration shown over an arcuate range of the order of 60° and are separated from each other by an arc of 60° , as seen in FIG. 2. The members 10 and 11 are thus arranged so that their extensions 13, 14, 15 and 13*a*, 14*a*, 15*a* may fit within each other, as shown in FIG. 1 and also in FIG. 5, and may extend through the arcuate openings 20, 21, 22 in each of the flanges where they extend out, as shown in FIG. 5, and they may actually form a part of the driving mechanism or receive the driving mechanism.

While three extensions are here shown for each flange, a larger or smaller number may be used. Preferably, the spaces between the extensions from each flange are equal to or close to the transverse dimension of each extension so that the extensions will interleave when the flanges are put together.

As may be seen more particularly from FIG. 3, the alignment of the extensions 13*a*, 14*a*, 15*a* is such as to form a part of the recess 30 of circular crosssection which includes the curved elements 31 at the inside of each of the extensions Similar curved elements 31 at the inside of each of the extensions 13, 14, 15 match up with the curved elements on the opposite extensions in order to form the recess 30 as a continous tube. This continous tube forms an efficient bearing for the spool or reel so that the spool or reel may be mounted for rotation on another shaft or secured to the other shaft for rotation thereby. This is a marked distinction and a marked advance over structures previously known wherein the support for the adjustable structure required additional elements added to and not inherently a part of the adjustable structure.

By means of this type of structure, the spool or reel may thus be formed from a plurality of disparate parts which may be cast in a single mold with pairs of elements formed by the mold as mirror images of each other used for opposite ends of the spool or reel. This provides for complete adjustability of the spool or reel with respect to the spacing between the opposite flanges. When the spool or reel is thus assembled, it may be releasably secured together or permanently secured together, as the occasion demands, depending on the type of securement used, whether it is a readily-releasable adhesive or a permanently-adhering adhesive, or other securement means which result in integrating of the reel structure.

While for most purposes, the spool or reel of the present invention may be made of plastic or molded plastic. It may also be made of molded or cast metal combinations of metal and plastic. In very large applications, it may be made of wood or a combination of wood and metal.

A single mold may produce the extension 15*a* on the left side of FIG. 2 or the extension 13 on the right side of FIG. 2. The detent 40 secures an end of the thread, filament or tape in order to hold the thread filament or tape on the shaft until at least one turn has been wound on the shaft of the spool. A detent 40 is produced on one side and the corresponding detent 40 is provided on the other side.

The novel features of the present invention include:

In manufacturing the reel or spool, the spacing between the opposite flanges is infinitely adjustable and may thus be fixed at any desired distance, depending, of course, on the length of the extending elements which together form the assembled shaft of the spool or reel.

The barrel or shaft between the flanges will, because of the segmented and complementary nature of the extensions, always be a complete circle in crosssection with no differences in the outside diameter.

There are three parts to each segment and the inside diameters are so arranged as to provide a perfect bearing surface for the spool to rotate on a shaft or an arbor. The utilization of three segments extending from each flange and the interleaving makes this possible.

The two opposite portions of the spool or reel are identical pieces They are mirror images of each other and may be made from the same mold.

The thread or tape holding slots or recesses in the segments are reversed from one side to the other allowing the spool to be rotated in either direction.

Clearance holes in each flange fit the barrel or shaft segments and provide a substantial part of the spool flange in the area between the outside barrel diameter and the inside diameter.

Any part of the multi-segment barrel which extends beyond the outside of the flange provides a driving surface for tension control if a keyed drive is not used.

If the multi-segment barrel is assembled to the maximum space between flanges, there will be a slight recess below the surface of the barrel. There will still be a driving surface provided by the multi-segment barrel but an adapter may be used to provide tension against this inner surface, the adapter being simply a short sleeve at one end of the barrel.

No prior spool or reel combines the moving barrel and the inside bearing surface which is infinitely adjustable.

All prior spools with fixed step adjustment have an inside diameter as a fixed part of the flange. There have been prior infinitely adjustable spools but with no specific inside bearing diameter.

Using large segments of both the barrel and the bore will thereby make a stronger spool than one with thin interlocking type spools adjustable to fixed spacings.

The segments do not require complete overlapping to be fastened together. While this will leave alternate spaces around the outer diameter of the barrel, this teaching will permit virtually every material to be wound. Only the most delicate materials would need a full barrel support.

Should the flanges be spaced so that there is a gap between the ends of the segments and the flange, an auxiliary support or sleeve may be used to fill in the cavity on each side to add stability to the reel while winding or unwinding.

Except when the end of the segments are flush with the outside surface of the flange, there is an extra advantage. When the segments extend outside the surface of the flange, they can interlock with a driving mechanism to cause them to turn or be turned thereby.

The same interlocking feature may be used to have a series of reels on the same shaft drive one another through their interlocking segments.

If the segments do not protrude, the resulting cavities in the flange may also be used as drivers An extra adapter with matching segments on one side may be inserted then to be used as a driver.

If it is desirable to have a series of reels mounted on one shaft for gang slitting, an adapter with segments on two sides will provide interlocking driving when the segments do not extend through the flange.

If it is desirable to gang slit with a number of reels on a single shaft and it is further desirable to allow each reel to slip independently of the other, an adaptor may be used with segments on one side and a flat face on the opposite side. These flat-faced segments will slip on one another allowing each reel independent slippage. Under such an arrangement, take-up tension can be applied from either one or both ends of the shaft by spring pressure or other means of pressure.

The structure herein permits any radial size and any thickness of flange permitting more adjustable arrangements than heretofore possible. The segments may be made of any desired length to produce a shaft of any length between the flanges consistent with reasonable rigidity of the shaft and strength of the reel.

The adjustment can be cut down to almost a zero space between flanges, which is not possible in prior devices.

The essential element of the present invention is that there are no specific size limitations. A single cavity mold may be used with each side of the spool or reel being a mirror image of the other.

The equally-placed segments of the barrel or shaft will interlock with identically spaced segments from the opposite flange forming a complete barrel or shaft.

The segments will have an inside diameter which will rotate around any shaft. The shaft will be contacted about its 360° circumference by the eaved segments, and have an equal bearing surface on the reel or spool. Because the inside diameter will go across the entire width of the barrel, there will be equal contact at every point. Even when parts of the barrel segments protrude through the opposite flange, a symmetrical reel will still be formed. During assembly, a spacer of appropriate size can be inserted between the flanges, such spacer being arranged to be readily removable or insertable from just one side or two opposite sides to make sure that the flanges can be set to the right size.

The infinitely adjustable arrangement of the device can be set for a wide variety of materials including clean-room types of materials. It may also be set for the winding of items such as magnetic recording tapes, special solders for high-tech use, special solid adhesives for high-tech use, delicate plastics or metals, narrow textile ribbons or braids. Any flexible material that is normally mounted on a spool or reel may be used.

By utilization of the foregoing structure, an infinite variety of reels or spools may be made with any desired infinitely variable spacing between them and when completed they may be fixed with respect to each other in various ways, including releasable means by the utilization of adhesive or the utilization of more permanent methods. Two halves of the reel or spool may be made by a single mold and the elements interleaved; the utilization of the extensions and spaced by an amount equal to their width provides for a simplified interleaving of the extensions from opposite flanges while at the same time permitting the construction of the reel or spool to the exact desired spacing between the flanges.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A reel, comprising:

a first flange, first openings within said first flange, first extensions extending normal to said first flange, a second flange, second openings within said second flange, and second extensions extending normal to said second flange;

each one of said first and second extensions including an outer surface;

said first extensions defining a central opening through said first flange, said second extensions defining a central opening through said second flange;

said first and second extensions being interleaved with each other with said first and second flanges opposed to each other, said outer surfaces defining a barrel between said flanges, said first and second extensions defining a bearing centrally located within said barrel and coextensive with said central openings; and said first and second extensions being slidably interleaved with each other, said first openings being adapted to slidably receive said second extensions therethrough, said second openings being adapted to slidably receive said first extensions therethrough, whereby the distance between said opposed first and second flanges can be adjusted and then fixed in a desired position.

2. The reel of claim 1 each one of said extensions having an inner arcuate surface, said outer surfaces and said inner arcuate surfaces being concentric with each other, said bearing being a continous tubular bearing, said continous tubular bearing being defined by said inner arcuate surfaces.

3. The reel of claim 2 each one of said extensions having smooth sides between said surfaces.

4. The reel of claim 3 said first extensions consisting of three extensions, said second extensions consisting of three extensions each one of said outer surfaces defining a circular arc of 60° each one of said inner surfaces defining a circular arc of 60° said sides defining angles of 60°.

5. The reel of claim 1, further comprising rotating means for rotating said reel, said rotating means including said first openings.

6. The reel of claim 1 further comprising rotating means for rotating said reel, said extensions extending through said first and second openings, said rotating means including said first extensions.

* * * * *